US005658447A

United States Patent [19]

Watson et al.

[11] Patent Number: 5,658,447

[45] Date of Patent: Aug. 19, 1997

[54] ELECTROLYSIS CELL AND METHOD FOR METAL PRODUCTION

[75] Inventors: Kevin Drew Watson, Heidelberg; Drago Dragutin Juric, Victoria; Raymond Walter Shaw, Victoria; Geoffrey James Houston, Victoria, all of Australia

[73] Assignee: Comalco Aluminium Limited, Melbourne, Australia

[21] Appl. No.: 454,183

[22] PCT Filed: Dec. 17, 1993

[86] PCT No.: PCT/AU93/00661

§ 371 Date: Feb. 21, 1996

§ 102(e) Date: Feb. 21, 1996

[87] PCT Pub. No.: WO94/13861

PCT Pub. Date: Jun. 23, 1994

[30] Foreign Application Priority Data

Dec. 17, 1992 [AU] Australia ..... PL6412

[51] Int. Cl.[6] ..... C25C 3/00; C25C 3/06; C25C 3/08; C25C 7/00

[52] U.S. Cl. ..... 205/367; 205/372; 204/243 R

[58] Field of Search ..... 204/243 R–247; 205/372, 380, 381, 382, 387, 367

[56] References Cited

U.S. PATENT DOCUMENTS

| | | | |
|---|---|---|---|
| 3,459,515 | 8/1969 | Bergmann | 29/182 |
| 3,616,045 | 10/1971 | Kozar et al. | 156/326 |
| 3,723,287 | 3/1973 | Elliott | 204/243 R |
| 4,231,853 | 11/1980 | Rahn | 204/243 R |
| 4,396,481 | 8/1983 | Pawlek | 204/243 R |
| 4,443,313 | 4/1984 | Gesing et al. | 204/243 R X |
| 4,500,643 | 2/1985 | Gesing et al. | 501/96 |
| 4,511,449 | 4/1985 | Molnar | 204/243 |
| 4,560,448 | 12/1985 | Sane et al. | 204/67 |
| 4,605,634 | 8/1986 | DeAngelis | 501/96 |
| 4,612,103 | 9/1986 | Dewing et al. | 204/243 |
| 4,737,254 | 4/1988 | Gesing et al. | 204/243 |
| 4,746,363 | 5/1988 | DeAngelis | 75/244 |
| 4,824,531 | 4/1989 | Duruz et al. | 204/243 R X |
| 5,227,045 | 7/1993 | Townsend | 205/230 |

FOREIGN PATENT DOCUMENTS

| | | |
|---|---|---|
| 20968/83 | 11/1983 | Australia . |
| 0092525 | 10/1983 | European Pat. Off. . |
| 0094353 | 11/1983 | European Pat. Off. . |
| 0096001 | 12/1983 | European Pat. Off. . |
| 0 145 411 | 6/1985 | European Pat. Off. . |
| 185496 | 12/1987 | Hungary . |
| 2065174 | 6/1981 | United Kingdom . |

OTHER PUBLICATIONS

J. McIntyre et al "Performance Testing of Cathodic Materials and Design in a 16 kA Cell and a Test Bed", published in *Light Metals,* 1987.

F.P. Muller, "Grain Pre–Refining with Titanium Diboride in the Electrolytic Cell", Erzmetall 31(5), 216–220 (1978).

International Publication No. WO 83/00171 published Jan. 20, 1983.

International Publication No. WO 81/02170 published Aug. 6, 1981.

*Primary Examiner*—Donald R. Valentine

*Attorney, Agent, or Firm*—Nikaido Marmelstein Murray & Oram LLP

[57] ABSTRACT

An electrolytic reduction cell for the production of metal is provided, in which liquid metal is deposited at or adjacent an upper surface of a cathode. The electrolytic reduction cell includes an anode structure and a cathode located beneath the anode structure, wherein an upper portion of the cathode comprises an aggregate of particles sized and shaped such that in operation of the cell liquid metal is present in at least an upper part of the aggregate and a slurry of liquid metal and particles is established, the slurry comprising a substantially uniform dispersion of the particles in a continuous liquid phase of the liquid metal, the slurry having a viscosity sufficiently high such that under operating conditions of the cell the slurry is relatively immobile. Methods for the production of a metal by electrolysis in the electrolytic cell are also provided.

25 Claims, 5 Drawing Sheets

ELECTROLYSIS CELL AND METHOD FOR METAL PRODUCTION

The present invention relates to electrolytic cells for use in the production of metals by electrolysis and to cathodes for use therein. The invention is particularly suitable for use in the production of aluminium.

Aluminium is generally produced by the electrolysis of alumina. Alumina is dissolved in a bath of molten cryolite at a temperature in the range of 950°–1000° C. Carbonaceous electrodes are frequently used for both the cathode and the anode. The anode is placed uppermost in the electrolytic cell and the cathode structure generally forms the bottom floor of the cell.

In operation of the cell, the molten bath of cryolite and dissolved alumina sits between the cathode and the anode. Liquid aluminium metal is electrodeposited at the cathode. The cryolite bath is a very aggressive medium and will readily attack the electrode material at the cell operating temperature. This does not form a major problem with regards to the anodes as the anodes are consumed in the electrolytic reaction and require replacement every few weeks. As the anodes form the upper element of the cell, anode replacement is a relatively simple operation that does not cause great disruption to cell operation.

However, attack of the cathodes by the bath materials can cause severe operational problems. The cathode forms the lower part of the cell and indeed in most aluminium reduction pots, the bottom of the pot consists of a refractory layer having the carbonaceous cathodes being formed as a layer on top. Cathode replacement requires shut-down of the cell and removal of the lining. This procedure is obviously time consuming and represents down-time for the cell. Consequently, aluminium reduction cells are operated under conditions such that cathode life is in the order of 2 to 5 years.

To achieve such cathode life, aluminium reduction cells are generally operated under conditions such that exposure of the cathode to bath materials is substantially avoided. This is obtained in conventional cells by maintaining a pool of molten aluminium above the cathode. Molten aluminium does not attack the cathode to the same extent as the bath materials and hence protects the cathode from the bath. Although providing satisfactory cathode life, maintaining a pool of molten aluminium in the cell requires a number of compromises in cell operation, including the requirement that anode-cathode distance be greater than optimal. Aluminium reduction cells utilise large electric currents which, in turn, can create large electromagnetic fluxes. The electromagnetic fluxes contribute to the formation of wave motion within the pool of molten aluminium, making prediction of the exact depth of the aluminium pool, and therefore the minimum spacing between the anode and the interface between aluminium and cryolite somewhat imprecise. Therefore, in order to prevent the pool of molten aluminium contacting the anode and causing a short circuit in the cell, the anodes are positioned in the cell at a position substantially above the normal or expected position of the aluminium/cryolite interface. This reduces the efficiency of the cell.

A number of proposals have been made to try to reduce the anode—cathode distance. On proposal involves placing a packed bed of material, e.g. $TiB_2$ rods or rings, into the pool of aluminium to reduce the formation of waves in the aluminium pool. However in such packed bed cells, a safety margin must be incorporated into the anode—cathode distance in order to account for localised disruptions in the aluminium pool. Further, the packing is frequently produced from expensive materials in order to impart resistance to the corrosive effects of the bath materials.

An alternative cell construction which does away with the pool of molten aluminium above the cathode is the drained cathode cell. In such cells, the bulk of the aluminium metal is continuously drained from the cathode as it is formed, leaving only a thin film of molten aluminium on the surface of the cathode. Drained cathode cells permit close anode—cathode spacing which can result in greatly enhanced cell efficiency. Formation of a stable film of aluminium on the cathode requires that the cathode be made from a metal-wettable material. Furthermore, as only a thin film of aluminium protects the cathode from the bath material, the risk of bath material coming into contact with the cathode is increased. This means that the cathode must be made from bath resistant material, such as borides, nitrides and carbides of refractory hard metals. Preferred materials are both electrically conductive and aluminium wettable. Studies on drained cathode cells have generally found that very pure materials must be used for the cathodes in order to obtain sufficient resistance to the bath materials.

Past efforts to develop an energy efficient aluminium reduction cell have required the use of bath resistant materials either as the cathode or in close proximity to the cathode. For example, ceramics made from refractory hard materials have been proposed. Such ceramics have generally been formed by sintering very fine particles to produce shaped artefacts (e.g. rods, cylinders, pipes, tiles) by hot, cold or reaction sintering. The sintered shapes can be used as a loose fill in a packed bed cell or somehow attached to the carbonaceous substrate (e.g. by gluing, reaction bonding, physical anchoring). Sintered ceramics have been found to suffer detachment from carbon substrates, mechanical breakage during normal cell servicing operations such as tapping and anode setting and become infiltrated by aluminium metal and disrupted at grain boundaries. Once intergranular attack on the sintered ceramic has occurred, the very fine powders used to produce the ceramic become dislodged from the structure and entrained in the metal, thus being lost from the surface.

Other approaches have utilised cermets containing refractory hard materials, refractory hard material coatings produced by processes such as electrodeposition, chemical vapour deposition and plasma spraying, and refractory hard material composites. All of the above approaches aim to produce a coherent structure containing a refractory hard material, which coherent structure is preferably resistant to infiltration by molten metal.

An alternative cathode structure is described in U.S. Pat. No. 4,737,254 by Gesing et al. This patent describes a lining for an aluminium electrolytic reduction cell. The lining includes an upper layer which is penetrated by electrolyte during operation of the cell. The upper layer consists of a close-packed array of alumina shapes, with the gaps or voids between the shapes being filled by particulate alumina that includes a size fraction having an average particle diameter of not more that 20% of the average diameter of the shapes.

The upper layer is preferably made from sintered tabular alumina or fused alumina aggregate. The shapes are preferably spheres of diameter 5–30 mm. However, the patent states that the important requirement of the shapes is that they can pack to produce a rigid skeleton and a high bulk density. Two factors determine the size of the shapes. If the shapes are too large, then large voids may be left between them by shrinkage or movement of intervening material. If the shapes are too small, they may be easily mechanically displaced by the motion of the cell liquids or mechanical prodding. The patent further states that is has been found that an alumina lining containing a skeletal structure of 20 mm diameter alumina spheres is hard and dimensionally stable.

European Patent Application Nos. 145411 and 145412, both assigned to Alcan International Limited, relate to cathode current collectors embedded in the potlining of an aluminium reduction cell. The cathode current collector includes a section that has a major proportion of discrete bodies of a material that is electrically conductive and wettable by molten aluminium. The bodies are joined or surrounded by a minor proportion of an aluminium-containing metal. This section of the cathode current collector is positioned in the cell such that the metal is at least partly fluid when the cell is in operation.

The metal wettable bodies of the upper section of the cathode current collector are preferably present in a close packed array. The bodies are preferably of a regular shape and are large enough not to be readily shifted by magnetic stirring of the molten metal.

The cathode current collectors described in these European patent applications are embedded and completely surrounded by the potlining of the cell. Therefore, the potlining acts to stabilize the bodies that form the upper section of the cathode current collector. In another embodiment, a depression is formed in the potlining directly above the collector. The depression may be filled with relatively large balls of titanium diboride to stabilise the metal in the depression.

The present invention provides an electrolytic reduction cell for use in the electrolytic production of metal.

In a first aspect, the present invention provides an electrolytic reduction cell for the production of metal in which liquid metal is deposited at or adjacent an upper surface of a cathode, said electrolytic reduction cell including an anode structure and a cathode located beneath the anode structure wherein an upper portion of the cathode comprises an aggregate of particles sized and shaped such that in operation of the cell liquid metal is present in at least an upper part of the aggregate and a slurry of liquid metal and particles is established, said slurry having a viscosity sufficiently high such that under operating conditions of the cell the slurry is relatively immobile.

In another aspect, the present invention provides an electrolytic reduction cell for the production of metal in which liquid metal is deposited at or adjacent to an upper surface of a cathode, said cell including a cathode in which at least an upper portion thereof comprises an aggregate or particles, said particles having a specific gravity greater than the specific gravity of the metal, said particles being sized in the range of 0.1 μm to 1 mm or more.

As used throughout this specification, the term "slurry" is taken to mean a substantially uniform dispersion of particles in a continuous liquid phase of liquid metal.

In use of the cell of the present invention, liquid metal is able to penetrate or otherwise be present at least part way into the aggregate of particles to form a slurry of liquid metal and particles. The particle size distribution and shape of the particles in the aggregate of particles can be arranged to ensure that the thus formed slurry has a viscosity sufficiently high such that the slurry moves sluggishly, if at all, during operation of the electrolytic cell and therefore remains relatively immobile on the cathode surface. As the slurry remains relatively immobile, loss of the particles from the cathode during use occurs at only a slow rate, if at all. This rate of loss of particles can be sufficiently low to ensure that the cathode does not prematurely wear during use. Therefore, the protective effect of the particles may be maintained for the design life of the cathode.

The particles of the aggregate of particles are preferably produced from a material that is wetted by the liquid metal. However, particles of a non-wetted material may also be used. If the particles of non-wetted material are used, the maximum size of the particles is governed by the wetting angle and the requirement that the liquid phase be the continuous phase of the slurry. The maximum particle size for a material that is not wetted by the liquid metal can be determined using surface chemistry theory.

It is also preferred that the particles be made from a material that is electrically conductive, although this is not an absolute requirement of the present invention.

If non-electrically conductive particles are used, the content of liquid metal in the slurry that forms on the upper part of the cathode will ensure that flow of electrical current in the cell is maintained. If non-electrically conductive particles are used, the slurry should rest on an electrically conductive substrate or the cathode current collectors should be in contact with at least the lower part of the slurry.

In a preferred embodiment, the slurry of liquid metal and particles exhibits plastic flow properties. Fluids that exhibit plastic flow properties will not flow until a critical yield stress is applied to the fluid. Until the yield stress is exceeded, plastic fluids act as solids. Such fluids are also referred to as viscoplastic and in this regard reference is made to J. M. Coulson and J. F. Richardson, "Chemical Engineering, Volume 1," published by Pergamon Press, 1977, page 38. FIG. 1 also shows the relationship between shear stress and shear rate for different flow behaviours, and the yield stress for plastic fluids is clearly shown in this Figure.

The yield stress of a plastic fluid may be defined as the minimum stress required to produce a shearing flow. At shear stresses below the yield value, the material behaves as a solid. Once the yield value is exceeded, the fluid may display Newtonian, pseudoplastic or dilatant flow behaviour.

In an especially preferred embodiment, the cathode of the electrolytic reduction cell comprises a substrate having a coating on its upper surface, said coating comprising an aggregate of particles. In use, liquid metal penetrates or is otherwise present at least part way into the aggregate to form the slurry of liquid metal and particles.

The cell of the present invention differs substantially from prior art electrolytic reduction cells. In the prior art, the upper portion of the cathode of the cell was generally designed to prevent infiltration of liquid metal into the metal wettable material. Any infiltration of liquid metal usually resulted in progressive failure of the material. In contrast, the upper part of the cathode of the electrolytic reduction cell of the present invention has been designed such that it is at least partly penetrated by liquid metal to form a relatively immobile slurry layer and this relatively immobile slurry protects the cathode from further attack by the bath materials.

Furthermore, although some prior art patents describe systems in which metal penetrated into a potlining, these systems use particles having relatively massive particle sizes to stabilise the flow of metal and give stability to the mixture of liquid and particles thus formed. The mixture of liquid and particles that is formed in these earlier patents is akin to a packed bed and is of a very different character to the slurry formed in the present invention in which the liquid metal forms the continuous phase.

In yet a further aspect, the present invention provides a method for the production of a metal by electrolysis in an electrolytic cell comprising an upper anode, a lower cathode and an electrolysis bath therebetween in which liquid metal is deposited at or adjacent an upper surface of the cathode wherein an upper portion of the cathode comprises an aggregate of particles said method characterised in that liquid metal is present in at least an upper part of the aggregate and a slurry of liquid metal and particles is established, said slurry having a viscosity sufficiently high such that under the operating conditions of the cell the slurry is relatively immobile.

Preferably, the slurry exhibits plastic flow behaviour and has a yield stress that is sufficiently high to ensure that the operating conditions of the cell do not subject the slurry to a shear stress that exceeds its yield stress. The slurry is thereby substantially immobile.

The present invention is particularly suited to the production of aluminium metal and for convenience, the invention will hereafter be described with respect to the production of aluminium. However, it will be appreciated that the invention can be used in the production of any metal by an electrolytic process in which liquid metal is deposited at or adjacent the cathode.

As mentioned earlier, the particles are preferably produced from a substance that is wettable by the liquid metal, although non-wetted substances may also be used.

For the production of aluminium, the metal-wettable substance is preferably a boride, carbide or nitride of a refractory hard metal. The refractory hard metal may be selected from titanium, tantalum, niobium or zirconium. The preferred metal-wettable substance is titanium diboride. A mixture of different refractory hard metals may be used.

A number of non-wetted substances may also be used, including silicon carbide, alumina and particles sold by Comalco Aluminium Limited under the trade mark MICRAL (these particles are predominantly of a calcined bauxite material). The major requirements of the particles used in the aggregate are that they should be substantially unreactive with the molten metal (and perferably also the electrolytic bath) and they must be capable of being dispersed in molten aluminium to form a slurry.

The cathode used in the electrolytic reduction cell of the present invention preferably comprises a substrate having a coating that includes a refractory hard metal boride, carbide or nitride. The substrate may be a carbonaceous material. Although the cathode may be formed entirely from a material that includes a refractory hard metal boride, carbide or nitride, the relatively high expense of such borides, carbides or nitrides means that the use of a coating of such materials on a substrate is preferred in order to minimise the quantity of such materials required.

The substrate is preferably a non-smooth, preferably carbonaceous, substance suitable for use in aluminium electrolysis, such as anthracite, graphitised pitch or graphitised petroleum coke, metallurgical coke or titanium diboride—carbon composite. The surface of the substrate preferably has a degree of surface roughness to help prevent film slippage. Furthermore, the reaction between aluminium, bath and carbon leads to the formation of aluminium carbide at the interface between the slurry layer and the substrate. This aluminium carbide layer may provide mechanical keying between the substrate and the particles in the slurry layer.

The upper portion of or coating on the cathode is preferably formed from a graded aggregate of particles of borides, carbides or nitrides of a refractory hard metal. The particles of refractory hard metal borides, carbides or nitrides are preferably irregularly shaped and have particle sizes ranging from sub-micron up to 1 mm or more and more preferably between 5 and 500 microns. The aggregate preferably comprises particles or mixtures of particles, which have a higher specific gravity than aluminium and are wetted by aluminium. The particles are preferably single crystals. If multi-grain particles are used, it is possible that they will beak down during use of the cell. The upper size limit of particles is therefore somewhat restricted by the availability and cost of large single crystals. Break-down of large crystals will not create problems if the particles have crystal sizes and shapes compatible with the formation of a slurry. The solid particles are preferably electrically conductive. A range of particle sizes, shapes and mixtures thereof can be used, for example, hexagonal plates, elongated platelets, spindle shaped needles, cubic crystals, spherical particles or irregular shaped fractured crystals. The preferred combinations of particle shape, size and volume content of particles are set to give slurry with a suitable rheology to remain immobile during cell operation and resistance to dislodgement of individual particles from the upper surface of the slurry. One especially preferred embodiment comprises a mixture of particles having hexagonal platelet shapes and diameter 30–70 microns, irregular fracture particles in the range 150–350 microns and spindle particles having a maximum diameter of 30–50 microns and length of 150–350 microns.

The particles preferably have a specific gravity of at least 2.5 g/cm$^3$, with particles having a specific gravity in the range of 4–6 g/cm$^3$ being more preferred.

The layer of slurry on the upper part of the cathode during operation of the reduction cell may be formed in a number of different ways. One method includes manufacturing the cathode externally to the cell such that an upper part of the cathode comprises a bound aggregate of particles. This bound aggregate of particles is designed such that liquid metal can penetrate the aggregate during use. The bound aggregate is preferably formed by mixing particles of the required shapes and particle size distribution with a binder and applying the mixture to the upper surface of a cathode substrate.

The upper part of the cathode, or the coating on the cathode, is formed such that it will have sufficient mechanical strength to maintain physical integrity during storage and handling. This may be achieved by mixing the selected aggregate of particles of refractory hard metal borides, carbides or nitrides with any binder which is capable of keeping the particles in place until the cell is started up and liquid aluminium has a chance to infiltrate the aggregate. Ideally, the binder should be a substance which is ultimately capable of reacting with aluminium. In the case of the aggregate forming a coating on the upper surface of a substrate, the mixture of particles and binder may be applied to the substrate by way of spraying, trowelling, hot or cold pressing, ramming or vibropressing. The mixture preferably contains 70–100 percent of particles and 0–30 percent of binder, more preferably 90–100 percent of particles and 0–10 percent of binder.

The preferred binders are based on aqueous solutions of sugar, starch, poly-vinyl-alcohol, poly-vinyl-acetate, polyester, or acrylic, other water soluble organic substances such as phenol, resole, furfural alcohol, can be used. Inorganic substances soluble in water which upon drying are capable of temporarily cementing the aggregate and which do not react with the particles at high temperatures and are not detrimental to cell operations such as boric acid, aqueous solutions of fluorides or chlorides of sodium, aluminium or lithium can also be used. Alternative binders include aluminium powder and any thermo-plastic or thermosetting organic substance which upon application of heat is capable of holding the particles in place. If organic binders are used they should be capable of at least partially converting to carbon, e.g. coal tar, petroleum or wood pitch, polyurethane, thermosetting resins based on epoxy, phenol-formaldehyde, melamine etc. Aluminium metal powder can be used directly as a binder if the wettable layer is to be hot pressed as powder compact or it can be used in conjunction with an organic binder which holds the structure together during cell construction.

In an alternative method of forming the slurry, particles having the required shapes and particle size distribution may simply be added to an operating electrolysis cell. Upon addition to the cell, the particles will settle through the electrolysis bath and come to rest upon the cathode, thereby enabling establishment of the slurry. Not only is this an effective method of initially establishing the slurry, it also provides an effective method for maintaining the slurry layer and for re-establishing the slurry layer in case of disruption to the slurry layer during operation of the cell.

It is also possible to place an unbonded aggregate of particles onto the cathode substrate during start-up of the cell.

Metal matrix composite technology may also be utilised in order to obtain the desired slurry layer. In general terms, production of metal matrix composites involves mixing particulate material with a molten metal or molten alloy. The mixture is cast and allowed to set to form a composite article of metal and particles.

In one embodiment, the mixture of molten metal and particulate material is placed into an operating cell after start-up, which acts to form the slurry layer. In another embodiment, a slab or sheet of metal matrix composite is formed and allowed to solidify. The slab or sheet is placed on the upper surface of the cathode in the start-up procedure. As the cell comes on line, the aluminium metal in the metal matrix composite melts to form a slurry of particles in liquid metal.

In-situ generation of particles may also be used, although presently known methods result in the formation of particles with little or no control of particle size being obtained, or in the production of a sintered or other coherent coating, or in the production of particles that are washed off the cathode and recovered in the metal tapped from the cell. Therefore, present technology for in-situ generation of particles is probably not suitable by itself for the production of the desired slurry layer of the present invention. However, in-situ generation of particles may be used as a means of improving slurry stability or repairing after disturbances by adding sediments/free particles to fill gaps between particles in the slurry formed by one of the other methods described above.

It will be appreciated that the above list of methods for producing the desired slurry layer is not exhaustive and that the invention extends to include any method of forming a slurry layer in a metal reduction electrolysis cell.

The slurry of liquid aluminium and particles of refractory hard metal boride, carbide or nitride that forms in use of the cathode of the present invention has a high viscosity which results in the slurry flowing at a low rate, if at all. Preferably, the viscosity of the slurry layer is at least an order of magnitude larger than the viscosity of the liquid metal and indeed the slurry may be designed such that its viscosity is several orders of magnitude larger than the viscosity of the liquid metal. More preferably, the slurry has plastic flow behaviour with a yield stress of at least $10N/m^2$, more preferably above $100N/m^2$.

The slurry is preferably about 1–10 mm, preferably 2–5 mm thick and forms a stable film on the surface of the cathode. Thicker slurry layers may be used if desired.

It is preferred that the particles comprise from 25 to 75%, by volume, of the slurry.

The electrolytic cell of the invention should be arranged such that the shear stresses are less than the yield stress of the slurry to enable the slurry layer of desired thickness (e.g. 2 mm) to remain stationary on the surface of the cathode. Furthermore, the hydrodynamic conditions in the bath must be such that the shear stress exerted by the bubble driven flow at the interface between the bath and the slurry is within a range which can maintain the slurry layer at the desired thickness. It should be noted that appropriate choice of particle size distribution and particle shapes of the particles in the aggregate should enable slurries to be produced that are stable under the operating conditions of most cells. Preferably the bath velocity in any portion of the bath/slurry interface should not exceed 10 cm/s. If the velocity is too high, disruption of the slurry may occur due to movement of the slurry or due to entrainment of particles, which causes loss of particles from the slurry. These operation requirements can be satisfied by using design principles described in U.S. Pat. No. 5,043,047, assigned to the present applicants. For example the cathode may have a primary slope of 4° along the longitudinal direction of the anode and two transverse slopes which start from the centre line of the anode at 1° and progressively increase towards the anode edge. The rate of increase of transverse slope is calculated such that the combination of bubble size, bubble velocity, anode burn profile and equilibrium ACD ensures that the bubble driven bath velocity at the surface of the slurry is preferably less than 10 cm/s.

In yet a further aspect, the present invention provides a cathode for use in an electrolytic cell for the production of a metal in which liquid metal is deposited at or adjacent an upper surface of the cathode, characterised in that an upper portion of the cathode comprises an aggregate of particles of a refractory hard metal boride, carbide or nitride, said particles having particle sizes ranging from 0.1 μm to 1 mm, said particles having a specific gravity of at least $2.5\ g/cm^3$.

This aggregate of particles is able to be penetrated at least part way by liquid metal to form a stable slurry of liquid metal and particles. The particles are preferably particles of titanium diboride and the cathode is preferably used in a reduction cell for the production of aluminium.

The cathode and electrolytic cell of the present invention is especially suitable for use as drained cathode cells in which aluminium is continuously removed from the cell as it is formed. In this configuration, the upper part of the cathode comprises a stable slurry of liquid aluminium and particles. Liquid aluminium is deposited upon this slurry as a thin film of liquid aluminium. The film of aluminium is a Newtonian fluid of lower viscosity than the slurry and continuously drains from the cathode. It is preferable that the cathode substrate is wetted by aluminium. This will enable the cell to continue to operate as a drained cathode cell if the slurry is momentarily disrupted or absent.

The present invention is based upon the discovery that it is possible to form a liquid metal—RHM boride, carbide or nitride slurry which has a high viscosity or, more preferably, exhibits plastic flow behaviour. The slurry can be hydrodynamically stable and thus relatively immobile. Unlike prior art cathodes which tried to minimise or completely avoid penetration of the liquid metal into the coating, the cathode of the present invention is designed such that liquid metal can penetrate into or be otherwise present in the coating. The coating is designed such that a stable slurry of liquid metal and particles of RHM borides, carbides or nitrides is formed. Preferably, the slurry exhibits plastic flow behaviour and, as will be well known by those skilled in the art, a plastic fluid will not flow until its yield stress is exceeded. Operation of the electrolysis cell and design of the cathode can ensure that the yield stress of the slurry is not exceeded at the cathode surface, with the result that the slurry remains relatively immobile and therefore degradation of the coating does not occur or is greatly reduced.

A further advantage of a slurry layer containing a substantial volume fraction of solid particles is that it may act as a diffusion barrier limiting mass transport. This may further decrease degradation of the coating.

The slurry may be repaired or reformed during cell operation by the addition of more metal wettable particles. This may be achieved by the addition of particles on their own, or in combination with a binder or by the formation of particles by in-situ reaction.

The uniformity and thickness of a slurry may be adjusted by raking or other mechanical means.

The present invention also differs markedly from known packed bed cathodes. Such packed bed cathodes utilise relatively massive particles that sit in the pool of liquid metal to restrict the flow of liquid metal. The massive particles act as baffles to reduce wave formation in the liquid metal pool that would otherwise arise due to electromagnetic fluxes present in the cell. The relatively massive particles do not form a slurry with the liquid metal.

BRIEF DESCRIPTION OF THE DRAWINGS

Preferred embodiments of the present invention will now be described with reference to the accompanying drawings and Examples. In the drawings:

Referring to FIG. 2, the cathode used in the electrolysis cell of the present invention includes substrate 2, which may be a carbonaceous substrate or a carbon/$TiB_2$ composite substrate. A stable layer 3 comprising a slurry of $TiB_2$ particles in molten aluminium sits on top of the cathode. This stable layer of slurry acts as the top part of the cathode during operation of the aluminium reduction cell. Liquid aluminium metal is deposited as a thin film 4 on top of the slurry layer. The film of aluminium metal has the properties of a Newtonian fluid and the liquid aluminium flows downwardly as it is formed. It will be appreciated that the reduction cell shown in FIG. 2 is being operated as a drained cathode cell. Electrolysis bath 5 and anode 6 are located above the cathode, as shown.

To determine the flow behaviour of a slurry of liquid aluminium and particulate $TiB_2$, a series of experiments were conducted. Qualitative behaviour of the $Al/TiB_2$ slurry was assessed using a technique described by Rosen and Foster, "Journal of Coatings Technology," Vol 50, No. 643, August 1978. In the experiment, a flow curve of shear stress vs shear rate was obtained for the $Al/TiB_2$ slurry at 850° C. The $Al/TiB_2$ slurry was contained in a graphite crucible of 50 mm inside diameter. A T-shaped spindle made from ⅛ inch diameter Inconel 601 rod was rotated in the slurry at various speeds (shear rate) using a Brookfield viscometer. The output from the viscometer (shear stress) was recorded as a function of time.

Figure 1:
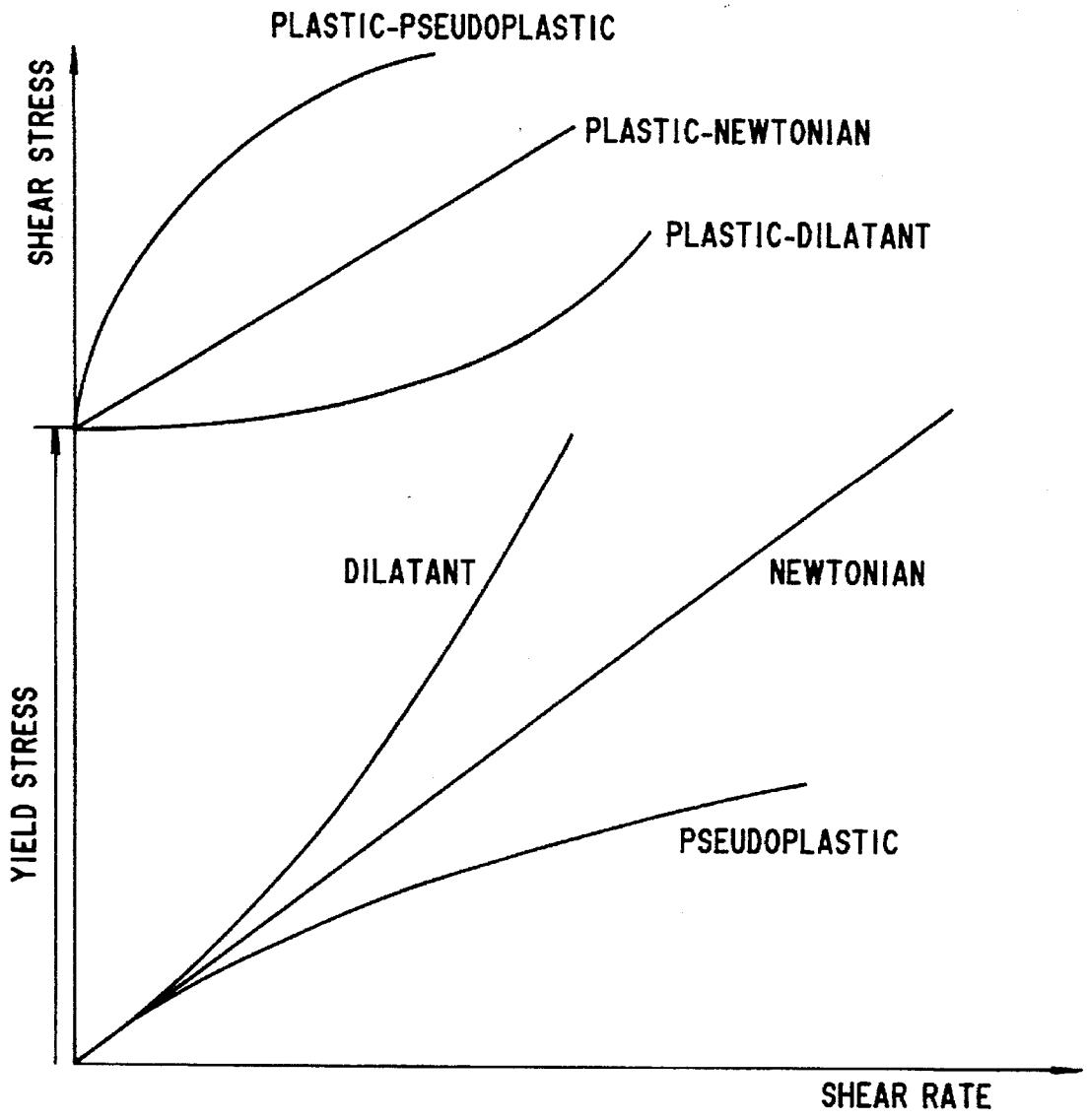
FIG. 1 shows the relationship between shear stress and shear rate for different flow behaviours.
Figure 2:
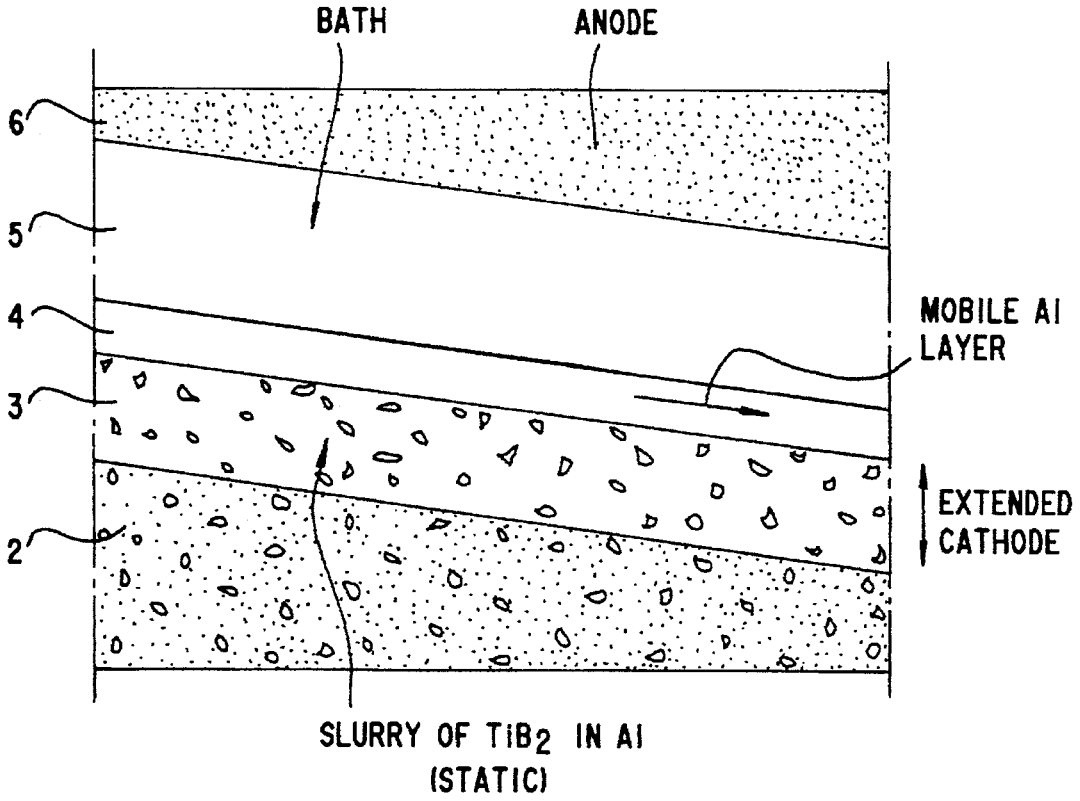
FIG. 2 shows a schematic diagram of a cathode having as slurry of Al/TiB on its upper surface.
Figure 3:
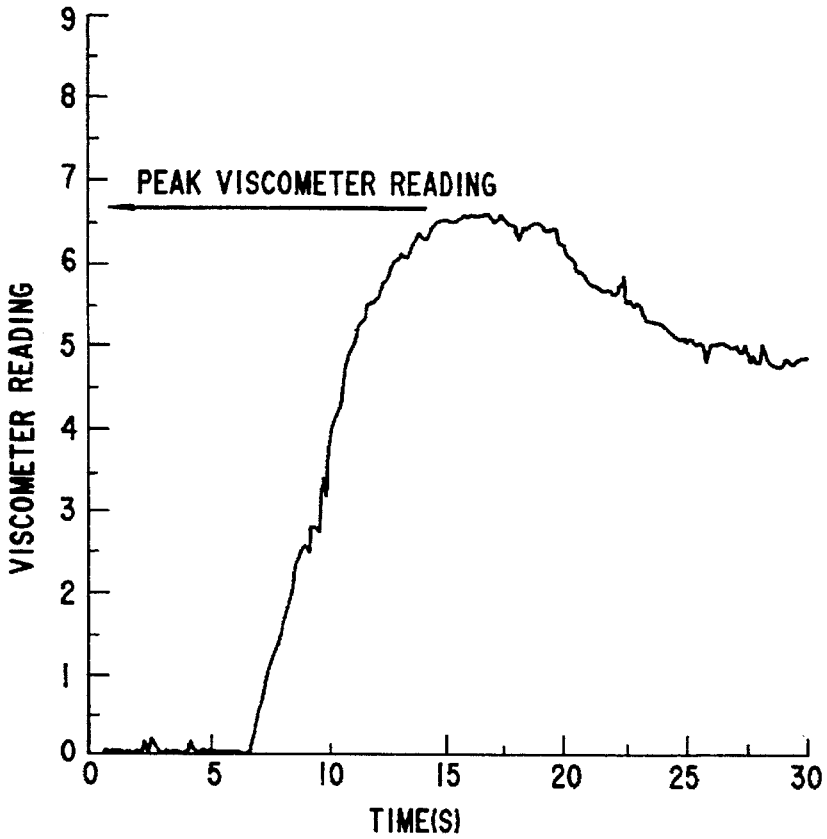
FIG. 3 is a plot of viscometer reading vs time from the flow behaviour tests for the $Al/TiB_2$ slurry, test −1.5 r.p.m.
Figure 4:
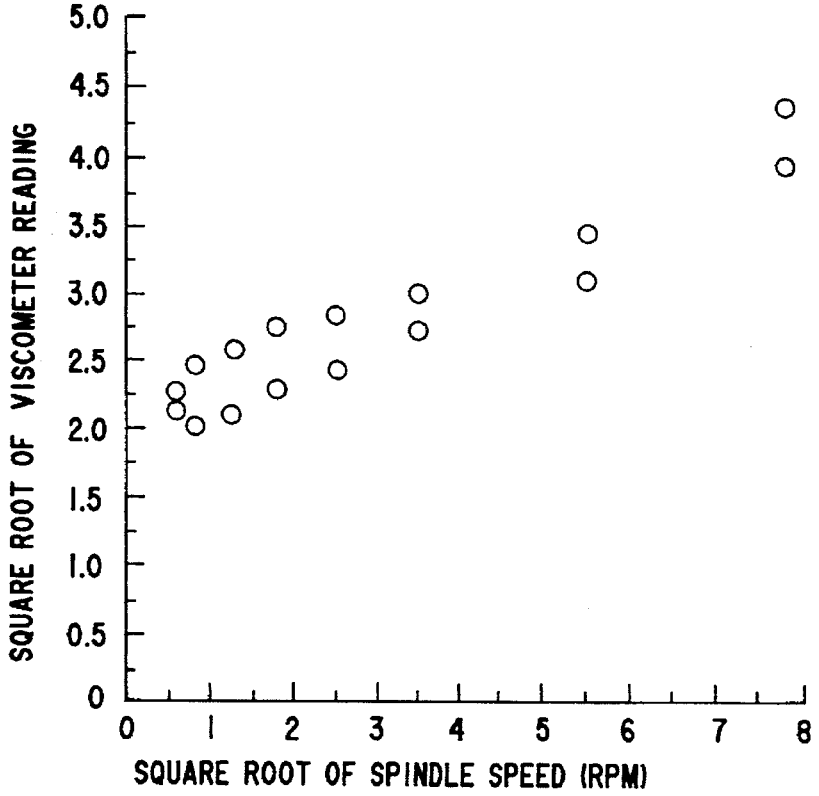
FIG. 4 is a plot of viscometer reading against spindle speed for the $Al/TiB_2$ slurry at 850° C.

A typical plot of the viscometer reading versus time is shown in FIG. 3. The plot in FIG. 3 for the $Al/TiB_2$ slurry, shows that the viscometer reading slowly increases until a peak is reached after which the viscometer reading falls and eventually flattens out. The viscometer reading is proportional to the torque supplied to the spindle. The torque-time response curve in FIG. 3 is typical of a material which displays a yield stress. The peak in the curve corresponds to the time at which yielding in the material occurred. The viscometer readings corresponding to the peaks, in the $Al/TiB_2$ slurry tests, are plotted as square root of viscometer reading against the square root of the spindle speed in FIG. 4.

The viscometer reading is proportional to shear stress and the spindle speed is proportional to shear rate. The plot in FIG. 4, for the $Al/TiB_2$ slurry, indicates a linear relationship which, if extrapolated to zero spindle speed, zero shear rate, would have a non-zero viscometer reading, shear stress. This indicates that the $Al/TiB_2$ slurry displayed a yield stress.

The yield stress of the slurry was measured by the technique of vane torsion developed by Dzuy and Boger, "Journal of Rheology," 27(4), 1983, pp 321–349.

In this technique a vane with 4–8 blades is immersed in a sample, rotated very slowly at a constant speed (<1 rpm) and the torque is monitored. The torque increases until the material yields, and the material shears instantly over the surface, the yield stress, $\tau_y$, is given by:

$$\tau_y = \frac{2 \cdot T}{\pi \cdot D^3} \left( \frac{1}{\frac{H}{D} + \frac{1}{3}} \right) \quad (1)$$

where T is the maximum torque, and D and H are the diameter and height of the vane respectively.

In this case a 4 bladed vane made from boron nitride was used to measure the yield stress of the $Al/TiB_2$ slurry at 1000° C. The vane used had the dimensions: D=20 mm, H=10 mm.

The yield stress of a number of $AlTiB_2$ slurries was measured at 1000° C. using the technique of vane torsion as described above. The results are shown as a plot of yield stress (Pa) versus volume fraction $TiB_2$ in FIG. 5. As can be seen from FIG. 5, slurries containing 30 vol % $TiB_2$ have a yield stress of about 350 Pa, slurries containing 50 vol % $TiB_2$ have a yield stress of approximately 1500 Pa, whilst slurries containing 58 vol % $TiB_2$ have a yield stress of approximately 4000 Pa.

A model was developed to estimate the shear stress to which an $Al/TiB_2$ slurry extended cathode might be subjected during DCC operation. The model considered the situation that occurs between one anode and the composite cathode in a single sloped cell.

The shear stress that an $Al/TiB_2$ slurry would experience during cell operation was estimated to be about 1.9 Pa (assuming a cathode slope of 5°). This value could increase to about 16 Pa at the extremes of the operational variable values expected in operation of a drained cathode cell. The possible variation in slurry height and cathode slope would lead to the largest changes in shear stress.

Figure 5:
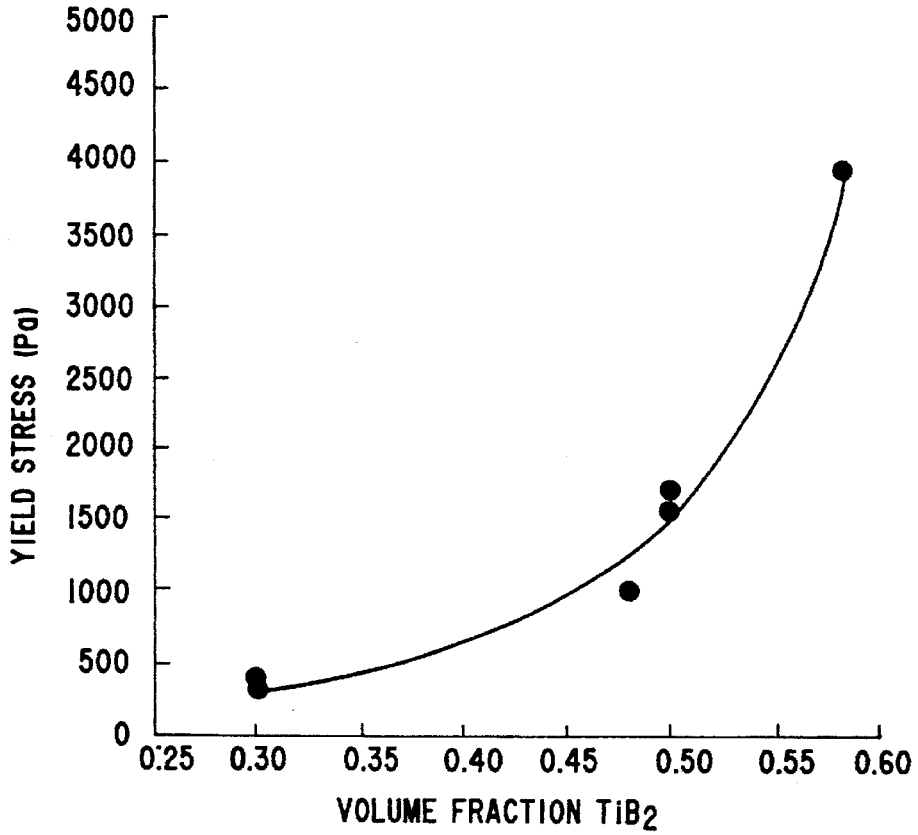
FIG. 5 is a plot showing yield stress (Pa) of $Al/TiB_2$ slurries at 1000° C. as a function of $TiB_2$ content of the slurry.

The yield stress of an $Al/TiB_2$ slurry with 50 volume % $TiB_2$ was measured to be about 1500 Pa at 1000° C. as per FIG. 5. The stress to which an $Al/TiB_2$ slurry would be subjected during typical DCC operation was calculated to be about 2 Pa. The maximum shear stress that could occur during normal DCC operation was calculated to be about 16 Pa. This suggests that the $Al/TiB_2$ slurry used in the yield stress measurements would remain static on the cathode surface during normal DCC operation.

One possible method for forming the slurry layers required in the present invention involves applying a coating of a $TiB_2$/carbon composite to the top part of a carbonaceous cathode. This coating is preferably of the order of 2.5 cm thick. During operation of the reduction cell, the carbonaceous matrix in which the $TiB_2$ particles are held is eroded by exposure to molten aluminium and cryolite. This causes the carbon matrix to wear away and results in the formation of free particles of $TiB_2$. If the particle size distribution and particle shapes of the $TiB_2$ particles is satisfactory, a slurry of $Al/TiB_2$ will form.

Figure 6:
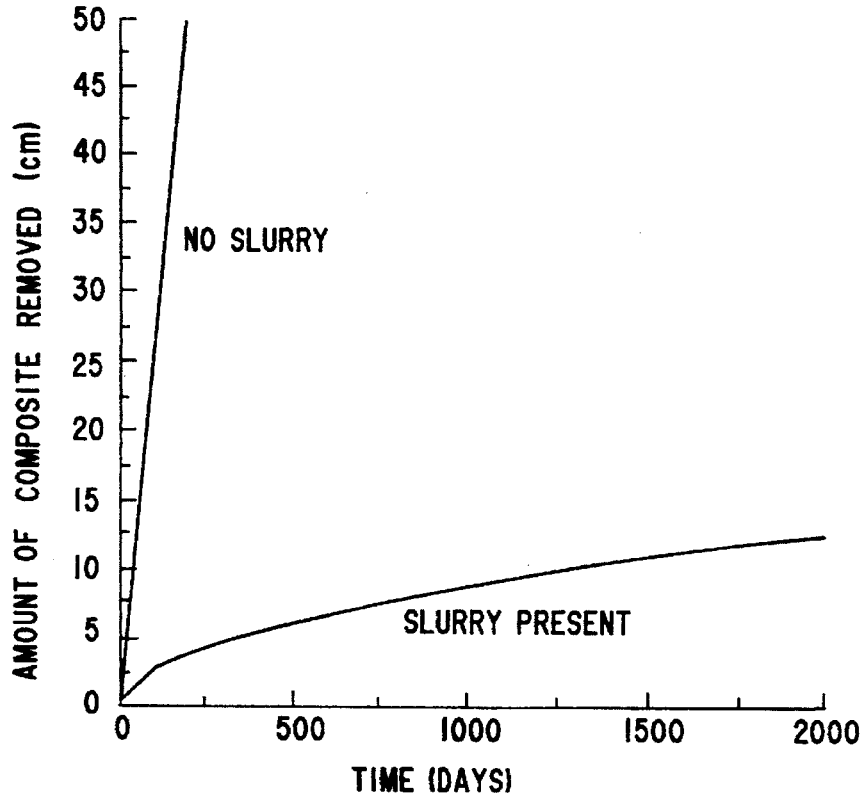
FIG. 6 shows a plot of wear of composite against time for situations where a slurry layer is present on the cathode and where no slurry layer is present.

It is generally accepted that the dominant wear mechanism for carbon based materials exposed to molten Al and cryolite is by reaction of carbon to form aluminium carbide, $Al_4C_3$. The cryolite provides a continual sink for $Al_4C_3$ removed via dissolution and oxidation of the dissolved species. Studies by the present inventors have shown that the diffusion co-efficient of carbon in the $Al/TiB_2$ slurry will be significantly less than in pure aluminium. Consequently, the wear rate of the composite material is greatly reduced if an $Al/TiB_2$ slurry is established on top of the composite. In the absence of a slurry the wear of the composite would be a linear function of time whereas if a stable slurry was maintained on the composite surface the wear would be a parabolic function of time, as per FIG. 6. It has been estimated that a 2.5 cm section of $TiB_2$/carbon composite will wear away completely in about 2 months if a slurry is not formed. With slurry formation, calculations have shown that only about 1 cm of the composite would be removed in 5 years.

The modelling and calculations used to show that a stable slurry layer can form during operation of a aluminium electrolysis all have been based on operation of the cell under standard conditions. However, it is possible that excursions beyond standard operating conditions could affect the stability of the slurry by causing movement of the slurry or by entrainment of $TiB_2$ particles, resulting in loss of particles from the slurry. Potential excursions beyond standard operation may be caused by anode effects, anode burn-offs and operation at very low anode-cathode distances. These operations are preferably minimised during operation of the electrolysis cell of the present invention. Furthermore, physical probing of the cathode surface should also be minimised, as this is an apparent source of slurry disruption.

Another possible method for producing the slurry layer involves placing $TiB_2$ powder of a desired particle size distribution and particle shapes on top of a carbon or composite substrate. Laboratory tests were carried out in which $TiB_2$ powder was placed on top of a substrate and exposed to aluminium and bath at 1000° C. The results indicate that a stable $Al/TiB_2$ slurry could be formed.

Formation of the slurry by placing $TiB_2$ powder on the substrate has the potential to decrease substrate wear during operation of the cell shortly after start-up. In cases where the substrate is a $TiB_2$/carbon composite, use of $TiB_2$ powder to rapidly establish the slurry can greatly reduce wear of the composite. For example, the amount of composite removed from a cathode under standard drained cathode all operating conditions during the first 2 years of cell life is estimated into be about 0.75 cm. The same cell would lose only about 0.3 cm of composite if an $Al/TiB_2$ slurry of 5 mm thickness was created on the cathode surface shortly after the cell was commissioned.

Addition of $TiB_2$ powder could also be used to reinforce or reform the $Al/TiB_2$ slurry in areas where the slurry has been disrupted.

The creation of an artificial $Al/TiB_2$ slurry could be achieved by a number of ways including:

1. Use of $TiB_2$ powder or preformed $Al/TiB_2$ composite during cell start-up.
2. Addition of $TiB_2$ powder to the cell after start-up.
3. Addition to $TiO_2$ and $B_2O_3$ to the bath to form $TiB_2$ in situ.
4. Addition of $B_2O_3$ to the bath to react with the $TiO_2$ that is naturally present in the $Al_2O_3$ fed to the cell.

For the first two methods the physical properties of the $TiB_2$ powder, such as particle size distribution and particle shape, could be tailored to maximise the yield stress of the slurry, and thus would maximise the stability of the slurry.

Addition of $TiB_2$ powder to an operational cell may also be used to repair or reinforce the slurry if the slurry is damaged or lost. During a trial, a DCC cell was operated that had a cathode comprising an area of a $TiB_2$/carbon composite and an area of graphitic cathode carbon. $TiB_2$ powder was added to the area of graphitic cathode carbon in an attempt to create an $Al/TiB_2$ slurry and assess its possible effects. The area of graphitic cathode carbon to which $TiB_2$ additions were made amounted to about 15% of the total cathode area. At the end of the trial the cell was cooled down and the cathode surface examined.

In the areas in which the $TiB_2$ powder additions were made metal pools of about 5 mm–10 mm in thickness were observed covering the graphitic cathode carbon.

Figure 7:
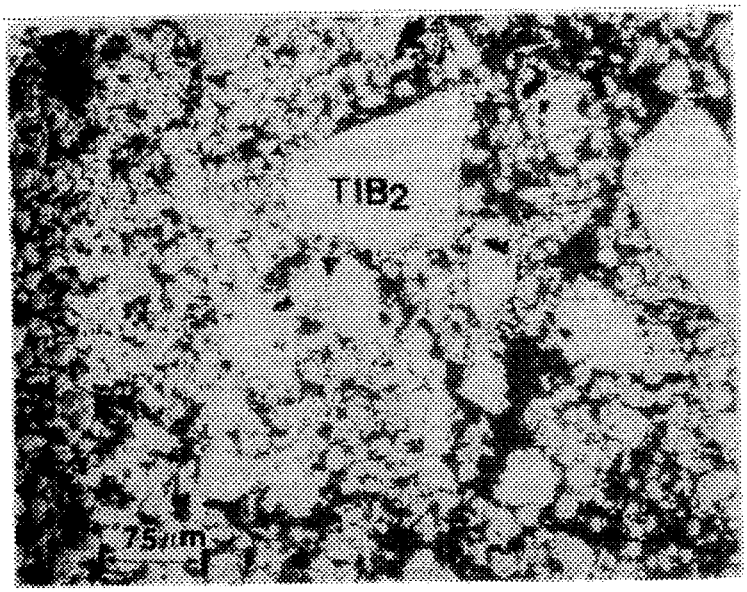
FIG. 7 is a back-scattered electron image of a typical $Al/TiB_2$ slurry formed via addition of $TiB_2$ particles to a drained cathode.
Figure 8:
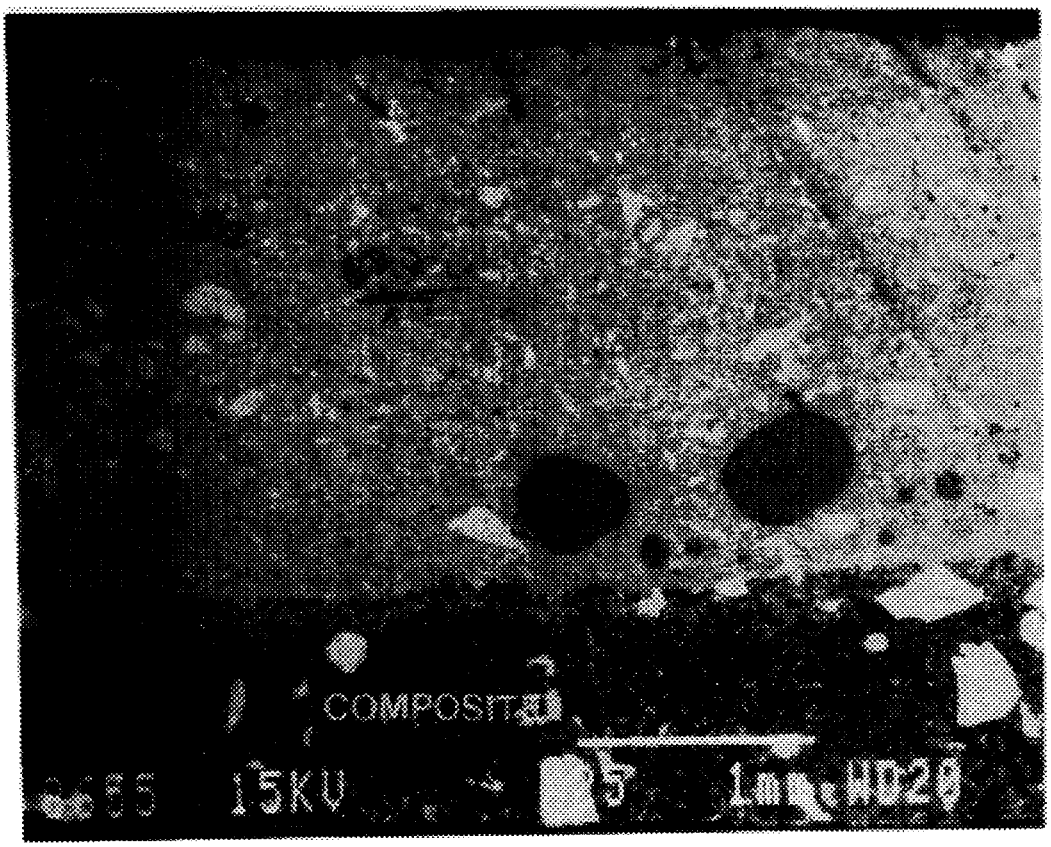
FIG. 8 is a back-scattered electron image of a typical $Al/TiB_2$ slurry formed from a $TiB_2$ carbon composite.

A sample of the metal from one of these locations was examined using an electron microprobe (Cameca Camebax). The microprobe examination revealed that the metal consisted of a dense slurry of $TiB_2$ particles in Al as shown in the back scattered electron image in FIG. 7. The content of $TiB_2$ particles was measured to be about 50 volume % and appeared to be uniform throughout the sample. $Al_4C_3$ was observed at the interface between the slurry and the cathode carbon.

The efficiency of the cell was the same as a cell with an entirely $TiB_2$-carbon composite cathode which suggests the areas of $Al/TiB_2$ slurry on carbon must have been producing Al.

The condition of the carbon beneath the slurry was better than was observed in a similar trial without addition of $TiB_2$ powder.

The preferred embodiments described herein have described a drained cathode cell having a slurry of $Al/TiB_2$ on a cathode that includes a carbon substrate. It will be appreciated, however, that the invention encompasses a much wider range of substrate and cathode materials. In particular, the substrate could be any electrically conductive, aluminium material and the slurry could contain any aluminium resistant solid particles, whether wetted or not by liquid aluminium. The only constraints are that the slurry possesses a sufficiently high viscosity or yield stress to remain immobile during cell operation and that the slurry completely covers the substrate.

Slurry formation is particularly useful for the operation of drained cathode cells. Slurry formation may also be useful in operation of "standard" aluminium reduction cells, as the slurry layer may act as a diffusion barrier against substrate/cathode wear by Aluminium carbide formation.

In conventional cells the erosion/corrosion of the carbon cathode is a major contributor to the limits in life. This is a particular problem in cells with higher metal velocities through using lower pad thicknesses and/or ineffective control of magnetic fields which can generate movement. This also restricts the use of more graphitised cathode blocks which although preferred for electrical and alkali resistance properties are much softer than the anthracitic blocks and therefore tend to wear more quickly.

The deliberate formation and retention of a slurry on the cathode surface offers a means of protecting these and increasing the cell life. This offers potential for better performance and opens up further opportunities in materials selection and cell design which are currently not economic.

The following experiments were conducted in order to demonstrate the formation of a stable layer of slurry.

EXAMPLE 1

An aggregate of RHM materials consisting of 50 parts of $TiB_2$ hexagonal platelets of −70+40μ and 50 parts of −250+100μ $B_4C$ platelets was thoroughly blended and sprayed with a solution of PVA onto all internal surfaces of a graphite crucible to form a tightly adhering layer of 2–3 mm in thickness. This coating was allowed to set and then an oxidation protection layer consisting of boron oxide powder and aluminium granules applied. The crucible was filled with bath and aluminium and heated up to the normal cell operating temperature and stirred for 24 hours to allow the aluminium to infiltrate the coating. The crucible was cooled, and autopsy showed that a slurry layer had formed.

EXAMPLE 2

An aggregate of spindle shaped needles of $ZrB_2$ was produced. Sixty parts of this materials having average size 150μ and 35 parts of irregular shaped fracture crystals of $TiB_2$ of average size of 300μ were mixed with 5 parts of molasses at 40° C. and trowelled onto internal surfaces of a graphite crucible to a thickness of 2–3 mm. The crucible was filled with aluminium and bath and heated to normal cell operating temperature in an inert atmosphere and held there whilst being stirred for 48 hours. The crucible was cooled and RHM—Aluminium layer recovered.

EXAMPLE 3

An aggregate of 80 parts of irregular shaped $TiB_2$ fracture crystals having average size 300μ was blended with 20 parts aluminium powder having average size 20μ and hot pressed at 500°–600° C. onto the carbonaceous substrate to form a 5 mm thick layer. This cement-like material was placed into a graphite crucible on an incline of 10°, the crucible filled with cryolite and fired to 1000° C. for 24 hours. The RHM—Aluminium slurry was examined and it was found that it had retained its original shape.

EXAMPLE 4

An aggregate consisting of 20 parts of irregular shaped fracture crystals of $TiB_2$ having average size 300μ, 40 parts of milled titanium diboride powder having average size 11μ, were formed into a $TiB_2$/C composite and used in a drained cathode electrolysis cell which was designed using principles from U.S. Pat. No. 5,043,047. As the carbon binder was removed from the composite a slurry formed on the surface of the composite which was found to be immobile. The wear of the $TiB_2$/C composite cathode after 6 months of operation in the drained mode was found to be approximately 4 mm.

EXAMPLE 5

This Example illustrates the formation of an Al/$TiB_2$ slurry using technology developed for production of metal matrix composites.

100 Kg of an aggregate of $TiB_2$ hexagonal platelets of +10–100 μm can be combined with 50 kg Al to produce a metal matrix composite using any of the techniques known to be suitable for the production of metal matrix composites, such as those described in Kjar A. R., Mihelich J. L., Sritharan T. and Heathcock C. J., "Particle Reinforced Aluminium - Based Composites", Light-Weight Alloys for Aerospace Applications, Ed, Lee H. W., Chia E. H. and Kim N. J., TMS, 1989. The composite can be melted and cast into tiles measuring 30 cm×30 cm×1 cm thick. The solid tiles can be placed onto a $TiB_2$-carbon composite cathode of a new drained cathode cell. Upon start-up of the cell the aluminium in the tiles will melt producing a drained cathode cell with a static Al/$TiB_2$ slurry of approximately 50 volume percent $TiB_2$ as the cathode. The yield stress of the slurry will be in the range of 1000–2000 Pa, as per FIG. 5.

EXAMPLE 6

A drained cathode aluminium electrolysis cell was designed using the principles from U.S. Pat. No. 5,043,047. This cell incorporated a $TiB_2$-carbon composite cathode that was produced with $TiB_2$ particles having sizes in the range of 10 μm to 1 mm. The cell was operated for 8 months. At the completion of the trial the cell was cooled and core samples of the $TiB_2$-carbon composite cathode were obtained. Cross-sections of the core samples were examined using an electron microprobe (Cameca Camebax). A layer consisting of a dense slurry of $TiB_2$ particles in Al was observed on the composite surface in all samples. A back-scattered electron image of a typical Al/$TiB_2$ slurry layer is shown in FIG. 11. The Al/$TiB_2$ slurry ranged in thickness up to 7 mm with an average of 2 mm. The $TiB_2$ particles in the slurry were of the same size range (10 μm–1 mm), morphology and chemical composition as those in the underlying $TiB_2$-carbon composite. Aluminium carbide ($Al_4C_2$) was observed at the interface between the Al/$TiB_2$ slurry and the $TiB_2$-carbon composite. This indicates that the Al/$TiB_2$ slurry formed as a result of removal of carbon from the composite via $Al_4C_3$ formation.

The concentration of the $TiB_2$ particles in the Al/$TiB_2$ slurry was measured to be about 55 volume percent. The slurry must have been essentially static during cell operation. Otherwise, if that amount of $TiB_2$ particles were continuously flowing off the cathode, the wear rate of the composite would have been much higher than observed.

Reference to FIG. 5 indicates that the Al/$TiB_2$ slurry observed on the composite would exhibit a yield stress of about 3000 Pa.

For a 7 mm thick Al/$TiB_2$ slurry on a cathode incline of 5° the shear stress acting on the slurry would be about 7 Pa. As the yield stress of the slurry is much greater than the applied shear stress it is deduced that the slurry would remain static on the cathode.

Throughout its operating life the current efficiency of the cell was greater than 90%. This indicates that the static Al/$TiB_2$ layer on top of the $TiB_2$-carbon composite was operating efficiently as a draining cathode.

Those skilled in the art will appreciate that the invention described herein may be subject to modifications and variations other than those specifically described. It is to be understood that the invention includes all such variations and modifications that fall within its spirit and scope.

We claim:

1. An electrolytic reduction cell for the production of metal in which liquid metal is deposited at or adjacent an upper surface of a cathode, said electrolytic reduction cell including an anode structure and a cathode located beneath the anode structure wherein an upper portion of the cathode comprises an aggregate of particles sized and shaped such that in operation of the cell liquid metal is present in at least an upper part of the aggregate and a slurry of liquid metal and particles is established, said slurry comprising a substantially uniform dispersion of said particles in a continuous liquid phase of said liquid metal, said slurry having a viscosity sufficiently high such that under operating conditions of the cell the slurry is relatively immobile.

2. An electrolytic reduction cell as claimed in claim 1 wherein said slurry exhibits plastic flow properties.

3. An electrolytic reduction cell as claimed in claim 2 wherein said slurry has a yield stress of at least $10N/m^2$.

4. An electrolytic reduction cell as claimed in claim 3 wherein said slurry has a yield stress of at least $100N/m^2$.

5. An electrolytic reduction cell as claimed in claim 1 wherein the aggregate of particles comprises particles having a particle size in the range of 0.1 μm to 1 mm.

6. An electrolytic reduction cell as claimed in claim 5 wherein the particles have a particle size in the range of 5 μm to 500 μm.

7. An electrolytic reduction cell as claimed in claim 1 wherein said slurry forms a layer 1 to 10 mm thick.

8. An electrolytic reduction cell as claimed in claim 7 wherein said slurry forms a layer 2 to 5 mm thick.

9. An electrolytic reduction cell as claimed in claim 1 wherein said particles are of a metal wettable material.

10. An electrolytic reduction cell as claimed in claim 9 wherein said particles are of a boride, carbide or nitride of a refractory hard metal.

11. An electrolytic reduction cell as claimed in claim 10 wherein said particles are particles of titanium diboride.

12. An electrolytic reduction cell as claimed in claim 1 wherein said aggregate forms a sedimentary layer on top of a cathode substrate material.

13. An electrolytic reduction cell as claimed in claim 1 wherein said particles have a specific gravity of at least 2.5 $g/cm^3$.

14. An electrolytic reduction cell as claimed in claim 1 wherein said particles comprise from 25 to 70 volume percent of said slurry.

15. A method for the production of a metal by electrolysis in an electrolytic cell comprising an upper anode, a lower cathode and an electrolysis bath therebetween in which liquid metal is deposited at or adjacent an upper surface of the cathode wherein an upper portion of the cathode comprises an aggregate of particles said method characterized in that liquid metal is present in at least an upper part of the aggregate and a slurry of liquid metal and particles is established, said slurry comprising a substantially uniform dispersion of said particles in a continuous liquid phase of said liquid metal, said slurry having a viscosity sufficiently high such that under operating conditions of the cell the slurry is relatively immobile.

16. A method as claimed in claim 15 wherein said slurry exhibits plastic flow behaviour and said slurry has a yield stress that is sufficiently high to ensure that said slurry remains substantially immobile under normal operating conditions in said cell.

17. A method as claimed in claim 16 wherein said slurry has a yield stress of at least $10N/m^2$.

18. A method as claimed in claim 17 wherein said slurry has a yield stress of at least $100N/m^2$.

19. A method as claimed in claim 15 wherein said aggregate of particles comprises a sedimentary layer on a cathode substrate material.

20. A method as claimed in claim 15 wherein said particles have a particle size in the range of 0.1 μm to 1 mm.

21. A method as claimed in claim 15 wherein said slurry forms a layer 1 to 10 mm thick.

22. A method as claimed in claim 15 wherein said particles are of a metal wettable material.

23. A method as claimed in claim 15 wherein said metal is aluminium and said particles are of a carbide, boride or nitride of a refractory hard metal.

24. A method as claimed in claim 15 wherein said cell is operated as a drained cathode cell in which liquid metal is continuously deposited on a top surface of said slurry and drains away whereby a thin film of liquid metal is formed on top of said slurry.

25. A method for the production of a metal by electrolysis in an electrolytic cell comprising an upper anode, a lower cathode and an electrolysis bath therebetween in which liquid metal is deposited at or adjacent an upper surface of the cathode wherein an upper portion of the cathode comprises an aggregate of particles said method characterized in that liquid metal is present in at least an upper part of the aggregate and a slurry of liquid metal and particles is established, said slurry having a viscosity sufficiently high such that under operating conditions of the cell the slurry is relatively immobile, wherein said slurry is established by a method selected from the following:

a) placing a mixture of particles and binder onto a cathode prior to start-up of said cell, which mixture of particles and binder is infiltrated by liquid metal during operation of said cell to form said slurry;

b) placing particles of the desired particle size distribution and particle shape into the cell during operation, whereby said particles settle on the cathode to form said slurry;

c) placing a slurry of liquid metal and particles onto the top surface of the cathode during operation of said cell;

d) placing a sheet or slab of a metal matrix composite on the cathode before or during cell start-up, wherein said metal matrix composite melts during cell operation to form said slurry; or e) placing an unbound aggregate of particles on said cathode before or during start-up, which aggregate is infiltrated by liquid metal during cell operation to form said slurry.

* * * * *